US005129138A

United States Patent [19]

Stensrud

[11] Patent Number: 5,129,138

[45] Date of Patent: Jul. 14, 1992

[54] MODULAR DRYWALL CONSTRUCTION METHOD

[76] Inventor: Jay Stensrud, 4350 Valdez Way, Reno, Nev. 89502

[21] Appl. No.: 553,255

[22] Filed: Jul. 16, 1990

[51] Int. Cl.[5] ..... B23P 11/02

[52] U.S. Cl. ..... 29/525.1; 29/897.3; 29/897.32; 52/468

[58] Field of Search ..... 29/897.3, 897.32, 525.1, 29/402.09, 402.14, 402.16; 52/459, 468, DIG. 4; 49/505

[56] References Cited

U.S. PATENT DOCUMENTS

| | | | |
|---|---|---|---|
| 3,305,993 | 2/1967 | Nelsson | 52/459 X |
| 3,411,252 | 11/1968 | Boyle, Jr. et al. | 52/468 X |
| 3,760,544 | 9/1973 | Hawes et al. | 52/459 X |
| 3,986,312 | 10/1976 | Calhoun et al. | 52/DIG. 4 X |

*Primary Examiner*—Joseph M. Gorski
*Assistant Examiner*—S. Thomas Hughes
*Attorney, Agent, or Firm*—Leon Gilden

[57] ABSTRACT

A modular drywall is erected wherein a metallic framework is initially formed including spaced vertical rails integrally and orthogonally mounting respective horizontal and vertical rails at upper and lower terminal ends respectively of the vertical rails. Drywall panels are subsequently fastened to forwardly projecting ends of the framework and subsequently filler strips are provided wherein the filler strips are formed to encompass and bridge gaps between drywall panels. The filler strips include a planar forward strip mouting a rearwardly extending longitudinally aligned projecting strip with a magnetic strip mounted to a rear end surface of the projecting strip to secure each filler strip to an associated metallic rail.

3 Claims, 4 Drawing Sheets

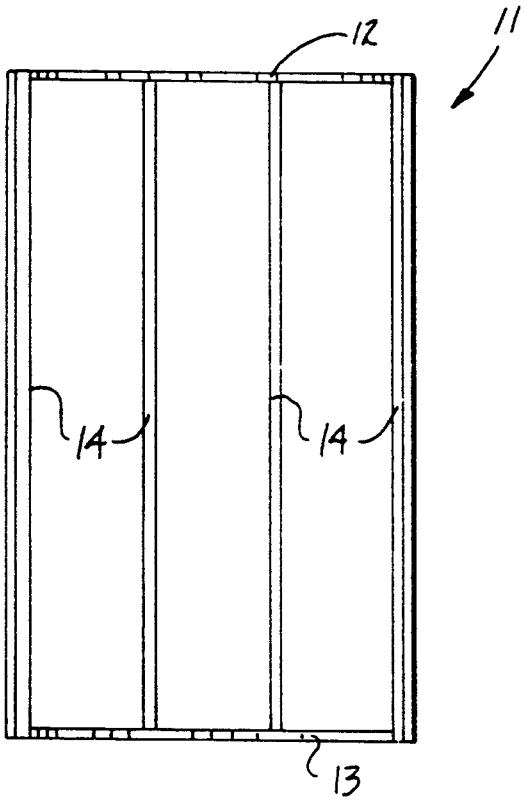
FIG 3
FIG 4
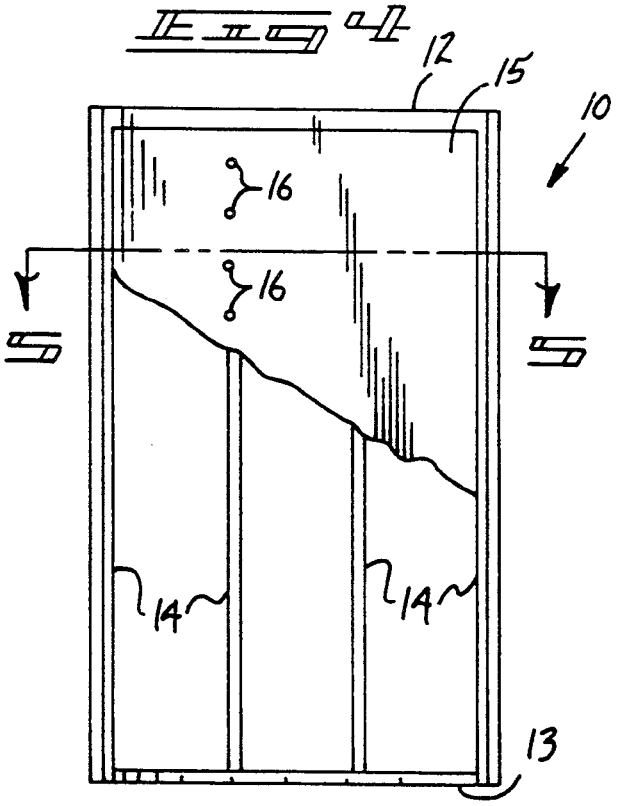

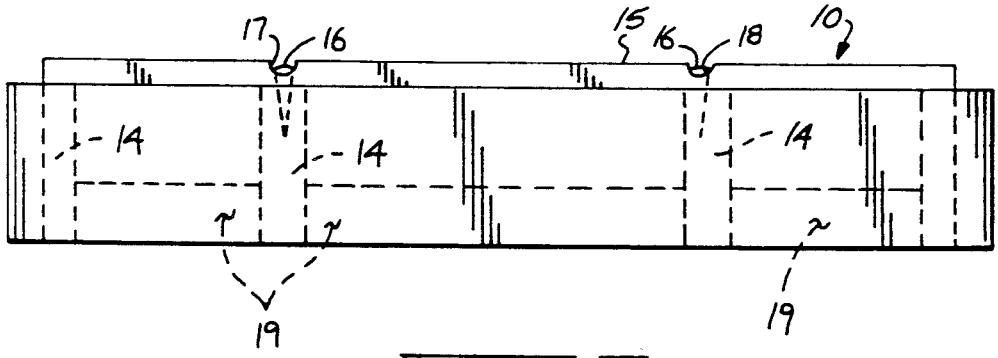
Fig 5
Fig 6
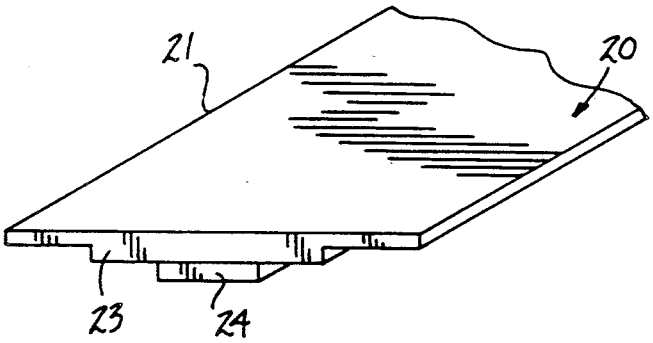
Fig 7
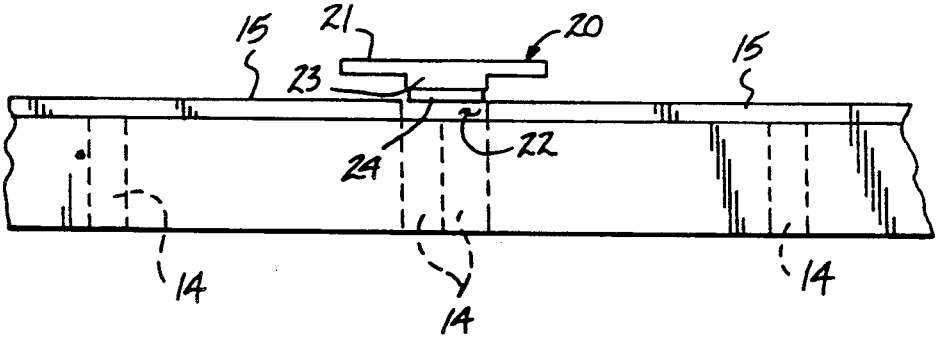

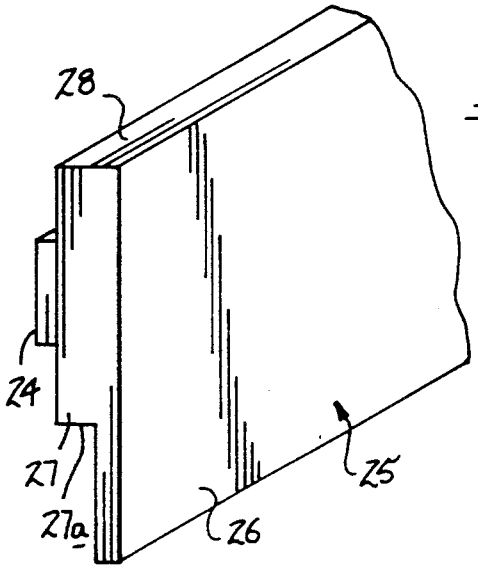
Fig 8
Fig 9
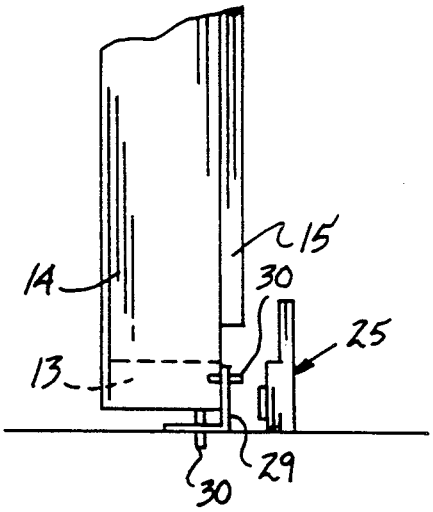
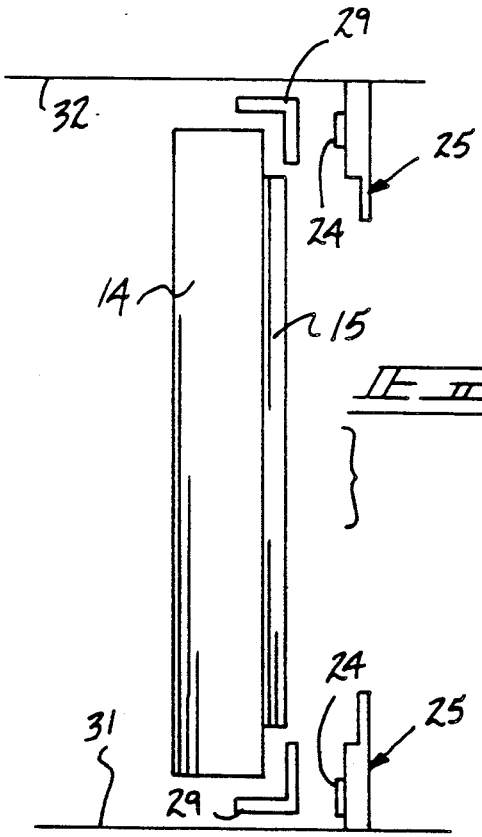
Fig 10

MODULAR DRYWALL CONSTRUCTION METHOD

BACKGROUND OF THE INVENTION

1 Field of the Invention

The field of the invention relates to wall construction, and more particularly pertains to a new and improved modular dry wall construction method wherein the same permits convenient and efficient construction of wall members which are mounted in an existing building.

2 Description of the Prior Art

Contemporary construction techniques require the efficient and effective utilization of labor and materials. With escalating labor and material costs, the construction of wall members and panels within buildings and particularly commercial buildings require such effective and efficient construction.

Prior art construction technics have not really lent themselves to such contemporary developments. For example U.S. Pat. No. 3,300,928 to KELLER sets forth a wall construction utilizing elaborate tongue and groove panels mounted relative to one another with an overlying cap mounted to an upper end of the panels to define an erected panel.

U.S. Pat. No. 4,160,349 to DESCHUTTER sets forth modular panel units mounted together in an offset relationship to provide insulated barrier to heat, cold, and sound.

U.S. Pat. No. 4,033,084 to SHIFLET sets forth a wall board construction wherein gypsum type wall board utilizes a facing construction utilizing fastener members mounted between side edges of the gypsum panels.

U.S. Pat. No. 3,950,910 to POBANZ provides a shelter panel utilizing planar and waffle members in alternating relationship mounted relative to one another to define a panel.

U.S. Pat. No. 2,662,043 to CLEMENTS provides an insulative building panel utilizing a matrix of crossed panels formed with notches to receive each other therewithin mounting end panels to define a completed panel structure.

As such, it may be appreciated that there continues to be a need for a new and improved modular drywall construction method wherein the same addresses both the problems of ease of use as well as effectiveness in construction and as such, the present invention substantially fulfills this need.

SUMMARY OF THE INVENTION

In view of the foregoing disadvantages inherent in the known types of panel constructions present in the prior art, the present invention provides a new and improved modular drywall construction method wherein the same provides convenient and efficient construction of wall panels between a ceiling and floor of an existing building construction. As such, the general purpose of the present invention, which will be described subsequently in greater detail, is to provide a new and improved modular drywall construction method which has all the advantages of the prior art drywall construction methods and none of the disadvantages.

To attain this, the modular drywall construction method of the instant invention essentially includes a modular drywall is erected wherein a metallic framework is initially formed including spaced vertical rails integrally and orthogonally mounting respective horizontal and vertical rails at upper and lower terminal ends respectively of the vertical rails. Drywall panels are subsequently fastened to forwardly projecting ends of the framework and subsequently filler strips are provided wherein the filler strips are formed to encompass and bridge gaps between drywall panels. The filler strips include a planar forward strip mounting a rearwardly extending longitudinally aligned projecting strip with a magnetic strip mounted to a rear end surface of the projecting strip to secure each filler strip to an associated metallic rail.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved modular drywall construction method which has all the advantages of the prior art modular drywall construction methods and none of the disadvantages.

It is another object of the present invention to provide a new and improved modular drywall construction method which may be easily and efficiently manufactured and marketed.

It is a further object of the present invention to provide a new and improved modular drywall construction method which is of a durable and reliable construction.

An even further object of the present invention is to provide a new and improved modular drywall construction method which is susceptible of a low cost of manufacture with regard to both materials and labor, and which accordingly is then susceptible of low prices of sale to the consuming public, thereby making such modular drywall construction methods economically available to the buying public.

Still yet another object of the present invention is to provide a new and improved modular drywall construction method which provides in the apparatuses and methods of the prior art some of the advantages thereof, while simultaneously overcoming some of the disadvantages normally associated therewith.

Still another object of the present invention is to provide a new and improved modular drywall construction method which may be compactly stored when not being utilized.

Yet another object of the present invention is to provide a new and improved modular drywall construction method wherein the same provides spaced fastening of drywall panels to a completed metallic framework utilizing magnetically secured filler panels to minimize labor and finishing costs of such drywall construction.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is an orthographic view taken in elevation of a framework utilized by the instant invention.

FIG. 4 is an orthographic view partially in section of a completed wall structure utilized by the instant invention.

FIG. 5 is an orthographic top view of the instant invention.

FIG. 6 is an isometric illustration of a vertical filler strip utilized by the instant invention.

FIG. 7 is an orthographic top view taken in elevation of the filler strip of FIG. 6 utilized between spaced drywall panels.

FIG. 8 is an isometric illustration of a horizontal filler strip utilized by the instant invention.

FIG. 9 is an orthographic side view of the horizontal filler strip utilized in conjunction with the drywall construction of the instant invention.

FIG. 10 illustrates an orthographic partially exploded view of the invention mounted between an existing floor and ceiling.

DESCRIPTION OF THE PREFERRED EMBODIMENT

Figure 1:
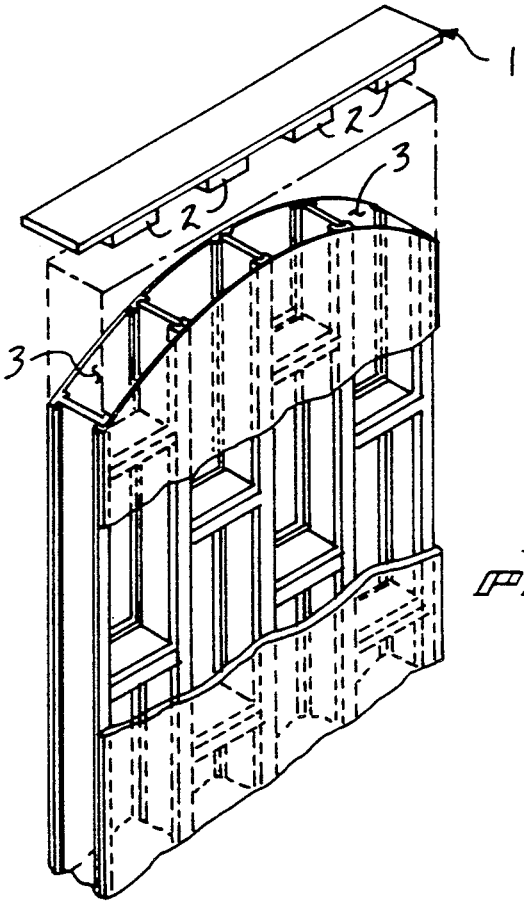
Fig 1 PRIOR ART
FIG. 1 is an isometric illustration of a prior art wall construction panel.

With reference now to the drawings, and in particular to FIGS. 1 to 10 thereof, a new and improved modular drywall construction method embodying the principles and concepts of the present invention and generally designated by the reference numeral 10 will be described.

Figure 2:
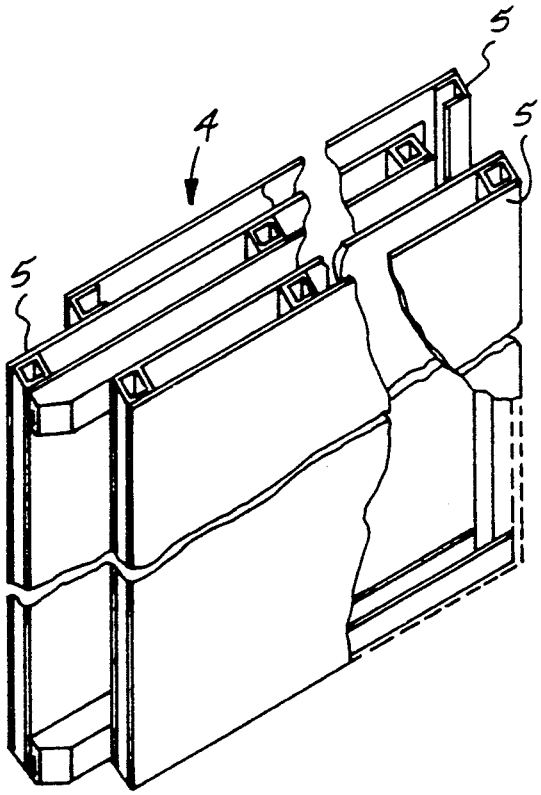
Fig 2 PRIOR ART
FIG. 2 is an isometric illustration of a further example of a wall construction panel.

FIG. 1 illustrates a typical prior art wall panel construction techniques wherein spaced vertical construction members utilize spaced horizontal projecting plates to define vertical cavities 3 wherein a top panel includes spaced projections 2 to interfit within the cavities 3 to define a top cap for the panel of construction. FIG. 2 illustrates a further prior art panel construction 4 wherein offset panels 5 are secured together to effect insulation for heat, sound, and the like once constructed.

More specifically, the modular drywall construction method of the instant invention essentially comprises initially erecting a metallic rectangular framework 11. The framework 11 comprise a series of spaced metallic parallel vertical rails 14 mounting an upper horizontal rail 12 and a lower horizontal rail 13 at respective upper and lower terminal ends of the vertical rails and wherein the horizontal rails are orthogonally oriented relative to the vertical rails to define the framework. The framework 11 once constructed includes forward end services lying in a single plane as illustrated in FIG. 5 for example. The framework 11 is then prepared to accomodate a series of gypsum type drywall panels 15 of generally rectangular configuration. To this end, apertures are directed through the panel 15 in alignment with the vertical rails 14 whereupon fasteners 16 are directed through the panels 15 and into the rearwardly positioned vertical rails 14 as illustrated in FIG. 5. Subsequently a filling compound 18 is positioned overlying the drywall panel cavities 17 formed during the drilling procedure. If desired, insulation 19 may be positioned interiorly of the framework rearwardly of the panels 15 between the vertical and horizontal rails to secure the insulation therewithin. During its construction, gap slots 22 are formed between adjacent drywall panels 15 as well as elongate gaps between upper and lower ends of the panels between the respective floor and ceiling 31 and 32 respectively (see FIG. 10).

Vertical T-shaped covering strips 20 are provided to fill the vertical gap slots 22. The T-shaped covering strips 20 include a vertical planar strip 21 that projects laterally to each side of a rearwardly positioned projecting strip 23. The projecting strip 23 includes a rear face mounting an elongate strip magnet 24 thereon. The T-shaped vertical covering strips 20 are cut to a predetermined length substantially equal to the predetermined length defined by vertical heights of each of the panels 15. To accordingly cover and overly upper and lower gap slots (see FIG. 9 for example) horizontal covering strips 25 are provided (see FIG. 8). The horizontal covering strips 25 include a horizontal strip surface 26 of generally planar construction utilizing a rearwardly directed projecting strip 27 mounting the elongate strip magnet 24 at a rearward face thereof. The horizontal covering strips 25 are defined by a blunt side edge 28 to one side of the strip 25 with the horizontal strip 26 projecting laterally to one side only of the projecting strip 27. This defines a stepped portion 27*a* to overlie the lower horizontal edge of the panel 15 as the magnet 24 is secured magnetically against a lower or upper horizontal rail 12 or 13 in a similar manner as the magnet 24 in use with the T-shaped covering strips 20 is adhered to a forward surface of the vertical rails 14 as illustrated in FIG. 7.

The metallic framework 11 is of a height less than that defined between a floor and ceiling 31 and 32 respectively, L-shaped brackets 29 assist in mounting of the horizontal framework 11 utilizing fastener members 30 wherein the fastener members 30 are mounted orthogonally within the horizontal rails and to the associated floor and ceiling as illustrated in FIG. 9 for example.

As to the manner of usage and operation of the instant invention, the same should be apparent from the above disclosure and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A method of modular wall construction comprising the steps of, fabricating metallic framework including providing a plurality of horizontal and vertical metallic rails, the horizontal and vertical metallic rails each defining a forward end surface, and wherein the step of fabricating includes a further step of mounting the vertical metallic rails in a spaced relationship between a floor and a ceiling and fastening the horizontal metallic rails at respective upper and lower terminal ends of the vertical metallic rails, and mounting drywall panels to the forward end surfaces of intermediate vertical rails and forming at least one elongate vertical gap between adjacent drywall panels and positioning said gap coextensively with a respective forward end surface of said forward end surfaces of the intermediate vertical rails, and forming respective upper and lower elongate horizontal gaps between upper and lower end edges of the drywall panels between the respective ceiling and floor, and wherein the step of mounting the drywall panels includes drilling apertures through the adjacent drywall panels and the intermediate vertical rails and further directing fasteners through the apertures into the intermediate vertical rails, and subsequently providing and directing a filling compound within the apertures overlying the fasteners in alignment with a forward surface of each panel to define a coextensive uninterrupted surface, and further providing at least one vertical "T" shaped covering strip to overlie the at least one vertical gap and the at least one vertical "T" shaped covering strip is defined by a predetermined length, and each panel defined by a predetermined height, and the length of at least one vertical "T" shaped covering strip is formed to equal the predetermined height, and wherein the at least one vertical "T" shaped covering strip is formed with a planar forward elongate strip, and an underlying projecting strip, the elongate strip is formed to extend laterally to each side of the projecting strip, and integrally mounting an elongate magnetic strip to the projecting strip, and magnetically adhering the magnetic strip to the respective forward end surface coextensive with the at least one vertical gap between the adjacent drywall panels, and including the step of further providing upper and lower covering strips each including a horizontal covering strip including a further projecting strip defining a step therebetween, and a further magnetic strip mounted coextensively to the furthe projecting strip of each horizontal covering strip, and magnetically adhering the further magnetic strip of respective upper and lower covering strips to respective metallic rails and horizontal.

2. A method as set forth in claim 1 further including the step of providing L-shaped brackets, and a further step of mounting and securing the L-shaped brackets fixedly to upper and lower ends of the metallic framework, thereby securing the metallic framework to the floor and the ceiling.

3. A method of modular wall construction comprising the steps of, fabricating metallic framework including providing a plurality of horizontal and vertical metallic rails, the horizontal and vertical metallic rails each defining a forward end surface, and wherein the step of fabricating includes a further step of mounting the vertical metallic rails in a spaced relationship between a floor and a ceiling and fastening the horizontal metallic rails at respective upper and lower terminal ends of the vertical metallic rails, and mounting drywall panels to the forward end surfaces of intermediate vertical rails and forming at least one elongate vertical gap between adjacent drywall panels and positioning said gap coextensively with a respective forward end surface of said forward end surfaces of the intermediate vertical rails, and forming respective upper and lower elongate horizontal gaps between upper and lower end edges of the drywall panels between the respective ceiling and floor, and wherein the step of mounting the drywall panels includes drilling apertures through the adjacent drywall panels and the intermediate vertical rails, and subsequently providing and directing a filling compound within the apertures overlying the fasteners in alignment with a forward surface of each panel to define a coextensive uninterrupted surface, and further providing at least one vertical "T" shaped covering strip to overlie the at least one vertical gap, and the at least one vertical "T" shaped covering strip is defined by a predetermined length, and each panel defined by a predetermined height, and the length of the at least one vertical "T" shaped covering strip is formed to equal the predetermined height, and wherein the at least one vertical "T" shaped covering strip is formed with a planar forward elongate strip, and an underlying projecting strip, the elongate strip is formed to extend laterally to each side of the projecting strip, and integrally mounting an elongate magnetic strip to the projecting strip, and magnetically adhering the magnetic strip to the respective forward end surface coextensive with the at least one vertical gap between adjacent drywall panels.

* * * * *